US007549722B2

(12) United States Patent
Heo

(10) Patent No.: US 7,549,722 B2
(45) Date of Patent: Jun. 23, 2009

(54) IMAGE FORMING APPARATUS HAVING HYBRID INKJET HEAD AND INKJET HEAD WIPING DEVICE

(75) Inventor: Gun Heo, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 412 days.

(21) Appl. No.: 11/466,850

(22) Filed: Aug. 24, 2006

(65) Prior Publication Data

US 2007/0070120 A1 Mar. 29, 2007

(30) Foreign Application Priority Data

Sep. 28, 2005 (KR) ..... 10-2005-0090714

(51) Int. Cl.
*B41J 2/165* (2006.01)
*B41J 2/155* (2006.01)
*B41J 2/21* (2006.01)

(52) U.S. Cl. ..... 347/22; 347/42; 347/43

(58) Field of Classification Search ..... 347/22, 347/29, 30, 32, 33, 42, 104
See application file for complete search history.

(56) References Cited

U.S. PATENT DOCUMENTS 5,432,539 A * 7/1995 Anderson ..... 347/33
5,627,571 A 5/1997 Anderson et al.
5,896,143 A * 4/1999 Matsui et al. ..... 347/24
5,988,787 A * 11/1999 Watanabe et al. ..... 347/22
6,164,753 A * 12/2000 Maza et al. ..... 347/32
6,783,209 B2 * 8/2004 Gompertz ..... 347/43
7,086,716 B2 * 8/2006 Steinfield et al. ..... 347/32
7,213,901 B2 * 5/2007 Bibl et al. ..... 347/22
2005/0156975 A1 7/2005 Inoue

FOREIGN PATENT DOCUMENTS

EP 0778151 6/1997
JP 8-118668 5/1996
JP 2002-178526 6/2002
JP 2003-11377 1/2003

OTHER PUBLICATIONS

European Search Report dated Feb. 12, 2007 issued in EP 06253975.4.

* cited by examiner

*Primary Examiner*—Shih-Wen Hsieh
(74) *Attorney, Agent, or Firm*—Stanzione & Kim, LLP

(57) ABSTRACT

An image forming apparatus having a hybrid inkjet head and an inkjet head wiping device includes an array type inkjet head, the first guide part, a carrier, a shuttle type inkjet head, a paper delivery unit, a controller, and a wiping device. The array type inkjet head prints an image onto a printing medium at a stationary state and has the first nozzle unit. The first guide part is spaced apart from the array type inkjet head to dace the array type inkjet head, and the carrier is movably coupled with the first guide part and reciprocates in a width direction of the printing medium. The shuttle type inkjet head has the second nozzle unit and the paper-delivery unit delivers the printing medium to the inkjet heads. The controller controls operations of the inkjet heads and the paper-delivery unit, and the wiping device contacts a surface of the first nozzle unit to wipe out residual ink from the first nozzle unit.

22 Claims, 8 Drawing Sheets

IMAGE FORMING APPARATUS HAVING HYBRID INKJET HEAD AND INKJET HEAD WIPING DEVICE

CROSS-REFERENCE TO RELATED APPLICATIONS

This application claims priority under 35 U.S.C. §119(a) from Korean Patent Application No. 10-2005-0090714, filed on Sep. 28, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus having a hybrid inkjet head and an inkjet head wiping device, and more particularly, to an image forming apparatus having a hybrid inkjet head and an inkjet head wiping device capable of performing both high-speed printing and high-resolution printing.

2. Description of the Related Art

An inkjet printer ejects fine ink droplets onto a desired position of a printing medium (e.g., paper or textile) to print an image of a predetermined color on a surface of the printing medium.

The inkjet printer has an inkjet head printing the image onto paper while performing a reciprocating motion in a direction (i.e., a width direction of the paper) perpendicular to a medium delivery direction of the paper. Such an inkjet printer is called an inkjet printer having a shuttle type inkjet head. The inkjet printer having a shuttle type inkjet head that prints the image while performing the reciprocating motion has high resolution but has a disadvantage of a slow printing speed.

Recently, an inkjet printer capable of printing an image in a high speed onto paper delivered in a stationary state without the reciprocating motion of an inkjet head by adopting an inkjet head array having a plurality of printheads disposed over the entire width of the paper, has been developed. Such an inkjet printer is also called an inkjet printer having an array type inkjet head. The inkjet printer has a high printing speed but has a disadvantage of low resolution.

The array type inkjet heads eject fine ink droplets onto a desired position of the paper. Also, the inkjet heads use thermal energy or a piezoelectric element as an ink ejection driving source.

A nozzle unit disposed on each inkjet head fires ink onto the paper. After printing is completed, residual ink or foreign substance left (remaining) after firing of the ink is performed is attached on a surface of the nozzle unit of the inkjet head. Since the residual ink or the foreign substance adheres to holes of the nozzle unit as time elapses, a nozzle malfunction where ink droplets are not fired when printing is performed may be generated, or a firing direction of the ink droplets may be deflected and thus an impact position of the ink droplets may be out of an exact position. Therefore, the inkjet image forming apparatus having the inkjet heads includes a wiping element that wipes out the residual ink or foreign substance stuck on the surface of the nozzle unit so as to maintain the surface of the nozzle unit clean. Also, the inkjet image forming apparatus includes a spitting element that fires ink to remove the foreign substance disposed in holes of the nozzle unit so as to maintain the nozzle unit blocking-free and a capping element that covers the nozzle unit when the image forming apparatus is in a standby state to prevent drying of ink and protect the nozzle unit from external foreign substance.

The above-described wiping element, spitting element, and capping element are commonly called a maintenance element. To manufacture a small-sized inkjet image forming apparatus, a small-sized and light-weight maintenance element is required.

Since a shuttle type inkjet printer has a small inkjet head, a problem is not particularly generated in connection with installation of the maintenance element. However, an array type inkjet head having a nozzle unit of a length that corresponds to the width of the paper and printing an image while delivering paper in a length direction of paper has a relatively long width. Accordingly, a space in which the maintenance element is installed is relatively wide. That is, when a predetermined maintenance operation is performed for the array type inkjet head, the inkjet head does not move to a maintenance region, and instead, the wiping element, spitting element, and capping element move, by turns, to the nozzle unit whose position is fixed.

Here, the wiping element has a wiper unit wiping out the residual ink on the surface of the nozzle unit and a wiper unit driving element that reciprocates the wiper unit in a wiping direction.

Therefore, in the inkjet printer having the array type inkjet head, it is difficult to reduce an installation space of the wiping element and a drive mechanism of the wiping element.

SUMMARY OF THE INVENTION

The present general inventive concept provides an image forming apparatus having a hybrid inkjet head capable of performing high-speed printing and/or high-resolution printing if necessary.

The present general inventive concept also provides an image forming apparatus capable of wiping a hybrid inkjet head while minimizing an installation space and reducing manufacturing costs.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an image forming apparatus including an array type inkjet head disposed in a stationary state to print an image onto a delivered printing medium and having a first nozzle unit with a length that corresponds to at least a width of the printing medium, a first guide part spaced apart from the array type inkjet head to face the array type inkjet head in a length direction of the array type inkjet head, a carrier movably coupled with the first guide part to perform a reciprocating motion in a width direction of the printing medium, a shuttle type inkjet head mounted in the carrier to print a second image onto the printing medium, and having a second nozzle unit, a paper delivery unit to deliver the printing medium to the inkjet heads, and a controller to control operations of the inkjet heads and the paper delivery unit to allow ink fired from at least one of the first nozzle unit and the second nozzle unit to be dispersed and impacted onto an appropriate position of the printing medium.

The foregoing and/or other aspects and advantages of the present general inventive concept may also be achieved by providing an image forming apparatus including an array type inkjet head disposed in a stationary state to print an image onto a delivered printing medium and having a first nozzle unit of a length that corresponds to at least a width of the printing medium, a first guide part spaced apart from the array type inkjet head to face the array type inkjet head in a length direction of the array type inkjet head, a carrier movably coupled with the first guide part to perform a reciprocating motion in a width direction of the printing medium, a shuttle type inkjet head mounted in the carrier to print a second image onto the printing medium, and having a second nozzle unit, a paper delivery unit to deliver the printing medium to the inkjet heads, a controller to control operations of the inkjet heads and the paper delivery unit to allow ink fired from at least one of the first nozzle unit and the second nozzle unit to be dispersed and impacted onto an appropriate position of the printing medium, and a wiping device to contact a surface of the first nozzle unit of the array type inkjet head to wipe out residual ink from the first nozzle unit.

The foregoing and/or other aspects and advantages of the present general inventive concept may also be achieved by providing an image forming apparatus including a first print head having a first nozzle unit, a second print head having a second nozzle unit, a carrier to accommodate the second print head, and a maintenance unit formed on the carrier to perform a maintenance operation on the first nozzle unit of the first print head.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
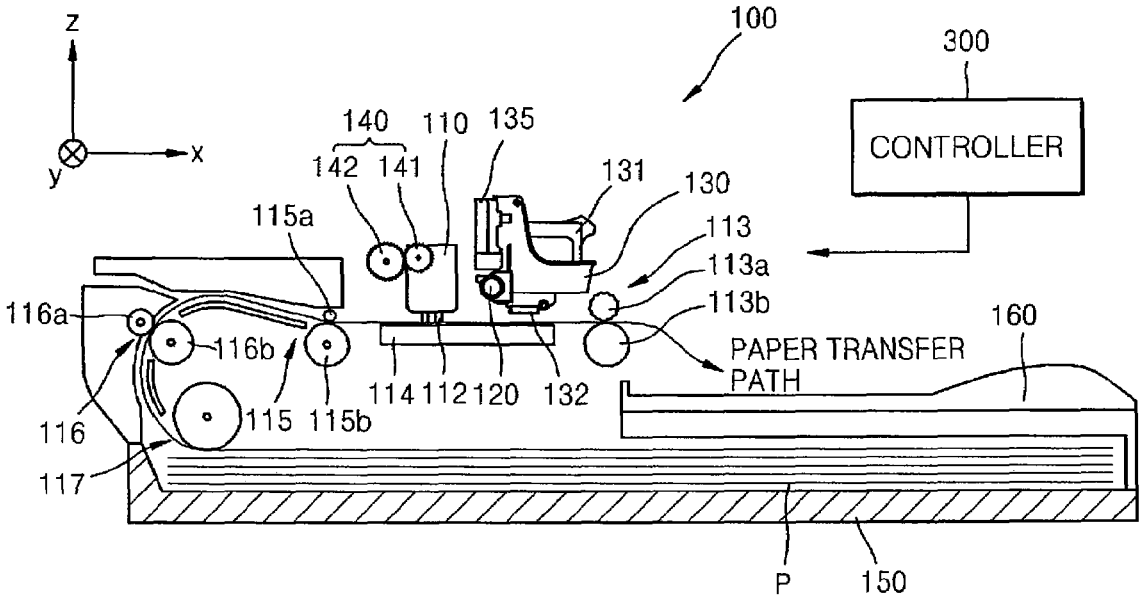
FIG. 1 is a sided sectional view illustrating an inkjet image forming apparatus having a hybrid inkjet head and a wiping device thereof according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
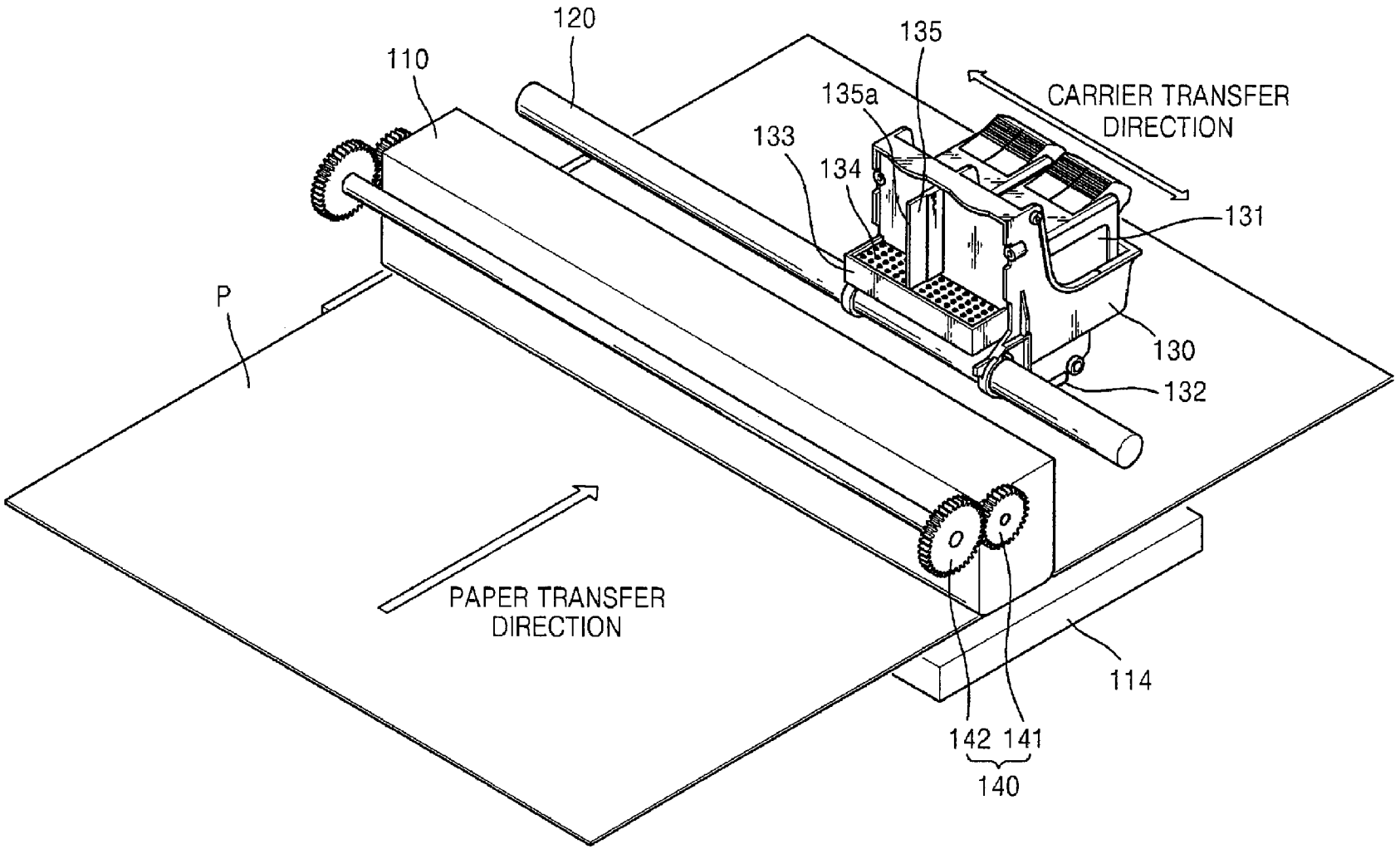
FIG. 2 is a partial perspective view illustrating the hybrid inkjet head and the wiping device of the image forming apparatus of FIG. 1.
Figure 3:
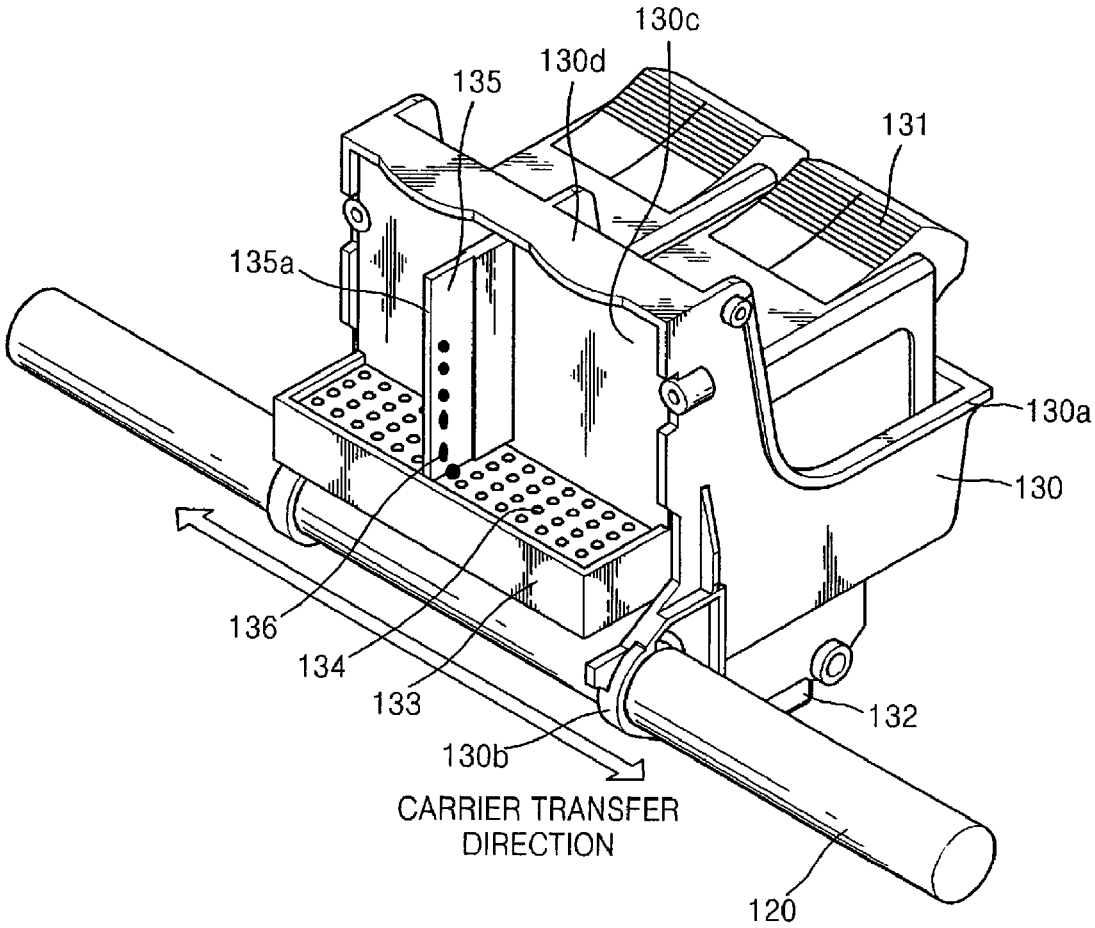
FIG. 3 is a partial enlarged perspective view illustrating a shuttle type inkjet head and a wiper unit of the image forming apparatus of FIG. 1.

FIG. 1 is a sided sectional view illustrating an inkjet image forming apparatus having a hybrid inkjet head and a wiping device thereof according to an embodiment of the present general inventive concept, FIG. 2 is a partial perspective view illustrating the hybrid inkjet head and the wiping device of the image forming apparatus of FIG. 1, and FIG. 3 is a partial enlarged perspective view illustrating a shuttle type inkjet head and a wiper unit of the image forming apparatus of FIG. 1.

Referring to FIGS. 1 through 3, the image forming apparatus 100 includes an array type inkjet head (first print head) 110, a shuttle type inkjet head (second print head) 132, a paper-supply cassette 150 to store a printing medium such as one or more sheets of paper P, a pickup roller 117 to pick up the paper P sheet by sheet, feeding units 115 and 116 including feeding rollers 115*a*, 115*b*, 116*a*, and 116*b* to deliver the picked-up paper P to nozzle units 112 and 132*a* (FIG. 4A) formed on the inkjet heads 110 and 132, respectively, a discharge unit 113 including discharge rollers 113*a* and 113*b* to discharge the printed paper P, a paper-discharging tray 160 in which discharged paper P is stacked, and a controller 300 to control a delivery operation of the paper-delivery units 115 and 116 and the pickup roller 117, and an ink firing operation of the nozzle units 112 and 132*a*. That is, the controller 300 controls the inkjet heads 110 and 132, the paper-delivery units 115 and 116, and the pickup roller 117, thereby allowing ink fired from the first nozzle unit 112 or the second nozzle unit 132*a* to be dispersed and impacted onto an appropriate position of the paper P disposed on a platen 114. In the above embodiment, the controller 300 also controls a delivery operation of a carrier 130 detachably mounted with the shuttle type inkjet head 132 to move the shuttle type inkjet head 132 in a width direction of the paper P to form an image on the paper P. Hereinafter, the paper-delivery units 115 and 116 and the pickup roller 117 are referred to as paper-delivery units.

Referring to FIG. 1, the paper P is delivered in an x-direction (in a feeding direction), and a y-direction is the width direction of the paper P. The array type inkjet head 110 has a first length in the y direction, and the shuttle type inkjet head 132 has a second length shorter than the first length. When the image has the same width as the paper P, the array type inkjet head 110 can print the image on the paper P in a stationary state without moving in the width direction (in the y direction), and the shuttle type inkjet head 132 needs to reciprocate in the width direction (in the y direction) to form the image on the paper P.

The array type inkjet head 110 prints an image onto the paper P delivered by the paper-delivery units 115, 116, and 117 at a stationary state and is mainly used for a high-speed printing where resolution is not important. The array type inkjet head 110 has the first nozzle unit 112 of a length that corresponds to at least a width of the paper P in the width direction. A gear unit 140 includes first and second gears 141 and 142 to move and/or rotate the array type inkjet head 110 with respect to a rotation axis of one of the first and second gears 141 and 142. The first gear 141 is axially coupled with a lateral side of the array type inkjet head 110 perpendicular to a length direction of the array type inkjet head 110, and the first gear 141 receives power from a driving source (not shown) through the second gear 142 to rotate.

A shaft-shaped first guide part 120 is disposed at a position facing the array type inkjet head 110. The first guide part 120 is spaced from the array type inkjet head 110 along the length direction of the array type inkjet head 110.

The first guide part 120 has the carrier 130 movably coupled thereto. The carrier 130 receives an ink cartridge 131 formed with the shuttle type inkjet head 132 and is driven by a driving element (not shown) to reciprocate in the width direction of the paper P.

The carrier 130 further has a wiper unit 135 to contact a surface of the first nozzle unit 112 of the array type inkjet head 110 and to wipe out residual ink from the first nozzle unit 112 of the array type inkjet head 110, and a waste ink collecting box 133 that collects the residual ink wiped out by the wiper unit 135. With such a construction, a separate installation space to install a wiping device, such as the wiper unit 135 to wipe out the first nozzle unit 112 of the array type inkjet head 110, and a separate waste ink collecting box is not required, so that a manufacturing cost can be reduced.

The wiper unit 135 may be fixedly mounted on the carrier 130. The carrier 130 may include a container portion 130*a* to accommodate the ink cartridge 131 formed with the shuttle type inkjet head 132, a connection portion 130*b* connected to the first guide part 120, and a maintenance portion 130*c* formed on a portion of the container portion and having the wiper unit 135 and the waste ink collecting box 133. The maintenance portion 130*c* may protrude from or be recessed from a plate 130*d* of the container portion 130*a* toward the array type inkjet head 110. The wiper unit 135 and/or the wiping plane (plate) 135*a* may have a length or a height in a z direction to correspond to a length of the nozzle unit 112 of the array type inkjet head 110 in the feeding direction (the x direction). The wiper unit 135 and/or the wiping plane 135*a* may have a width corresponding to a width of the shuttle type inkjet head 132 in the y direction (the width direction).

In the present embodiment, the wiper unit 135 is moved in a wiping direction together with the carrier 130 along the first guide part 120 and a wiping plane 135*a* contacting the first nozzle unit 112 is disposed to face a lateral side of the length direction of the array type inkjet head 110. With such a construction, a separate drive element is not required so as to move the wiper unit 135 in the wiping direction, so that a manufacturing cost can be reduced. Also, the wiper unit 135 may be formed of an elastic body (e.g., rubber) so as to prevent the first nozzle unit 112 from being damaged when a wiping operation is performed.

The waste ink collecting box 133 has an absorber 134 therein to absorb waste ink 136 wiped from the first nozzle unit 112 and collected into the waste ink collecting box 133. The absorber 134 may be an ink-absorbing material such as a sponge.

The second nozzle unit 132*a* to fire ink is installed on the shuttle type inkjet head 132. The shuttle type inkjet head 132 may be used when a high-resolution printing as well as high resolution is required, and the shuttle type inkjet head 132 may be used with the array type inkjet head 110 by turns or sequentially used before or after the array type inkjet head 110 is used to print, rather than simultaneously used with the array type inkjet head 110.

As described above, the image forming apparatus 100 has both the array type inkjet head 110 and the shuttle type inkjet head 132 and uses, by turns, these inkjet heads 110 and 132 appropriately for the use purpose, thereby performing a high-speed printing or a high-resolution printing. Here, in the case where the two type inkjet heads are adopted in the image forming apparatus as described above, these inkjet heads are commonly called a hybrid inkjet head.

The platen (or paper guide) 114 is disposed on a position to face the first and second nozzle units 112 and 132*a*.

The paper guide 114 supports a backside of the delivered paper P so that the nozzle units 112 and 132*a* may maintain a predetermined interval from the paper P.

The discharge roller 113 has a star wheel 113*a* installed in the width direction of the paper P and a support roller 113*b* to face the star wheel 113*a* to support the backside of the paper P. The star wheel 113*a* point-contacts a front side of the paper P to prevent contamination of an image formed by ink fired onto the paper P from the nozzle units 112 and/or 132*a* but not dried yet. If a next paper P is stacked before ink of the paper P stacked on a paper-discharging tray 160 is dried, the backside of the paper P might be contaminated. To prevent such contamination, a separate drying device (not shown) may be provided.

A maintenance operation performed on the nozzle units 112 may include an operation of capping the nozzle units 112 and 132*a* so that ink stored in the inkjet heads 110 and 132 may not be dried, an operation of wiping ink remaining on a surface of the nozzle units 112 and 132*a*, or an operation of spitting ink so that the nozzle units 112 and 132*a* may not be blocked.

Figure 4A:
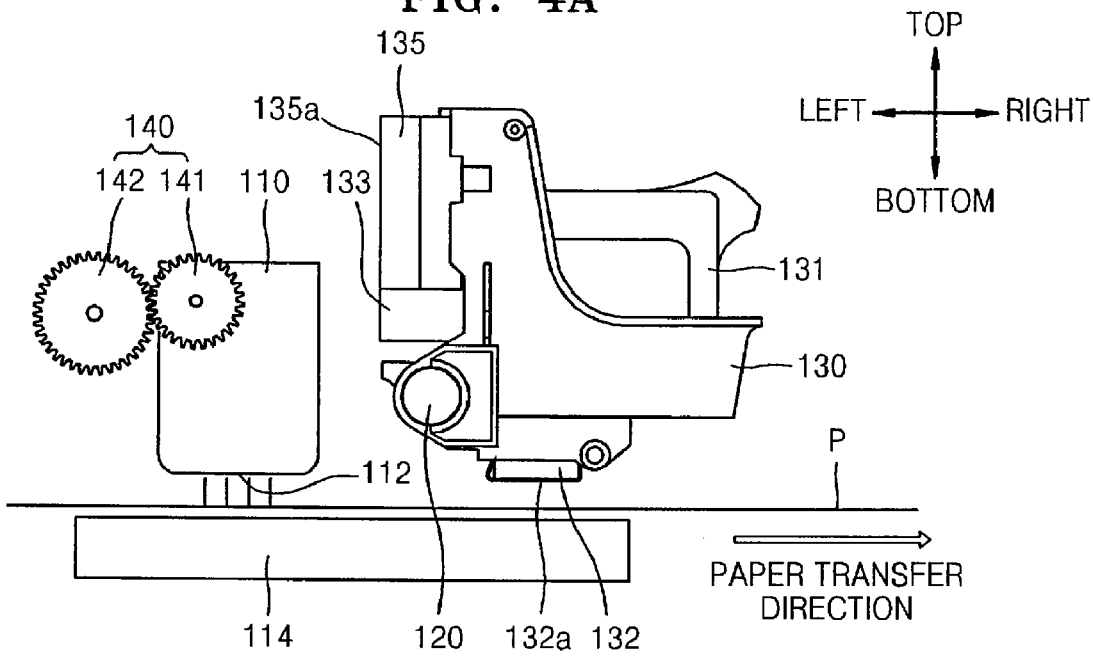
FIGS. 4A and 4B are sided views respectively illustrating a printing operation state and a wiping operation state of the hybrid inkjet head and the wiping device of the image forming apparatus of FIG. 1.
Figure 4B:
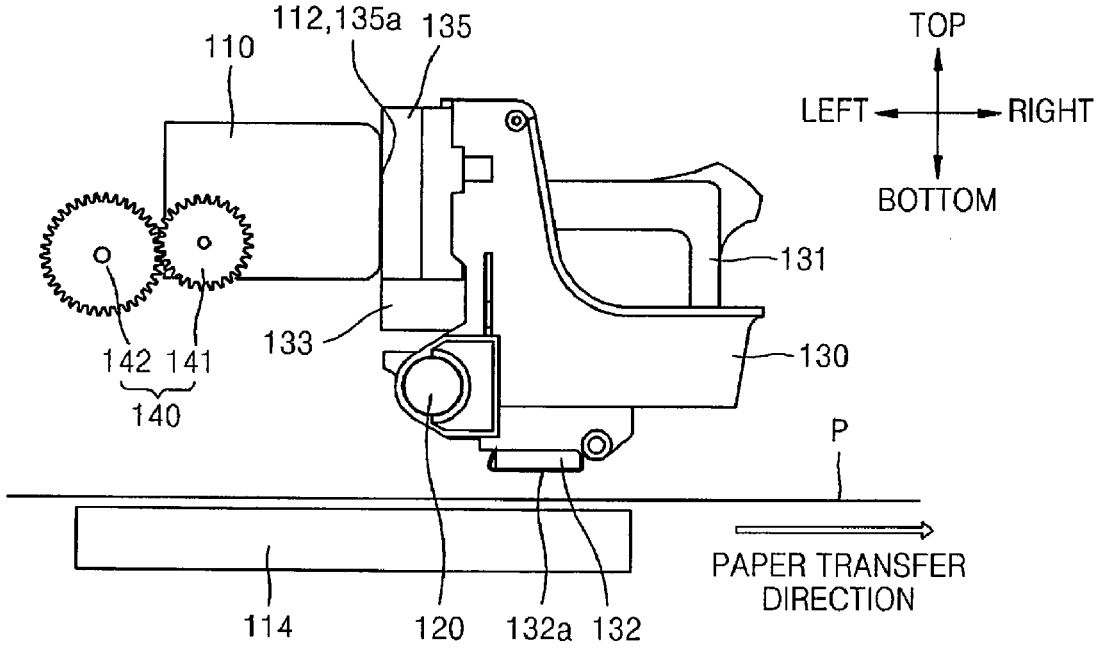
Figure 5A:
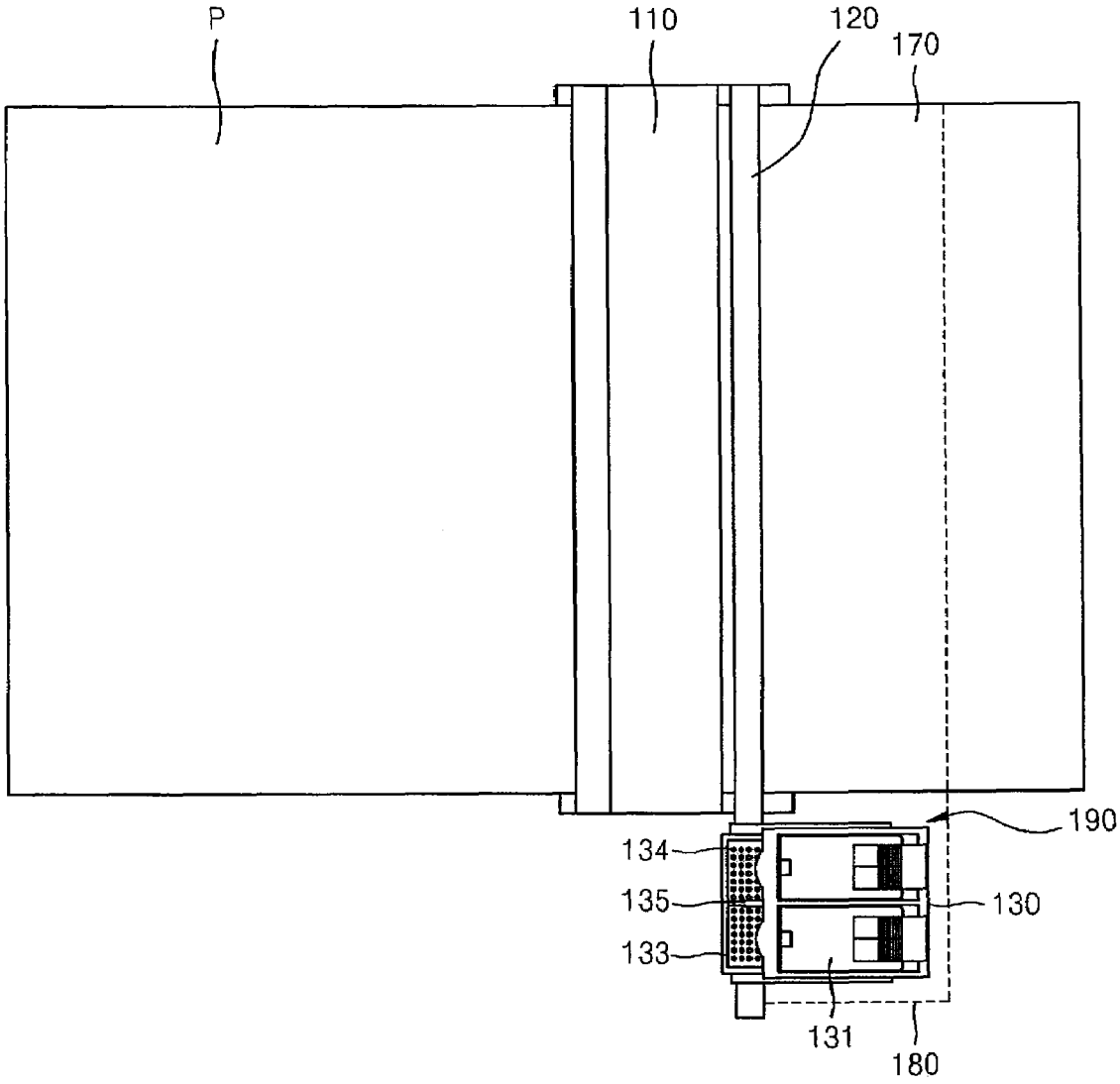
FIGS. 5A and 5B are plan views respectively illustrating a wiping operation standby state and a wiping operation state of the hybrid inkjet head and the wiping device of the image forming apparatus of FIG. 1.
Figure 5B:
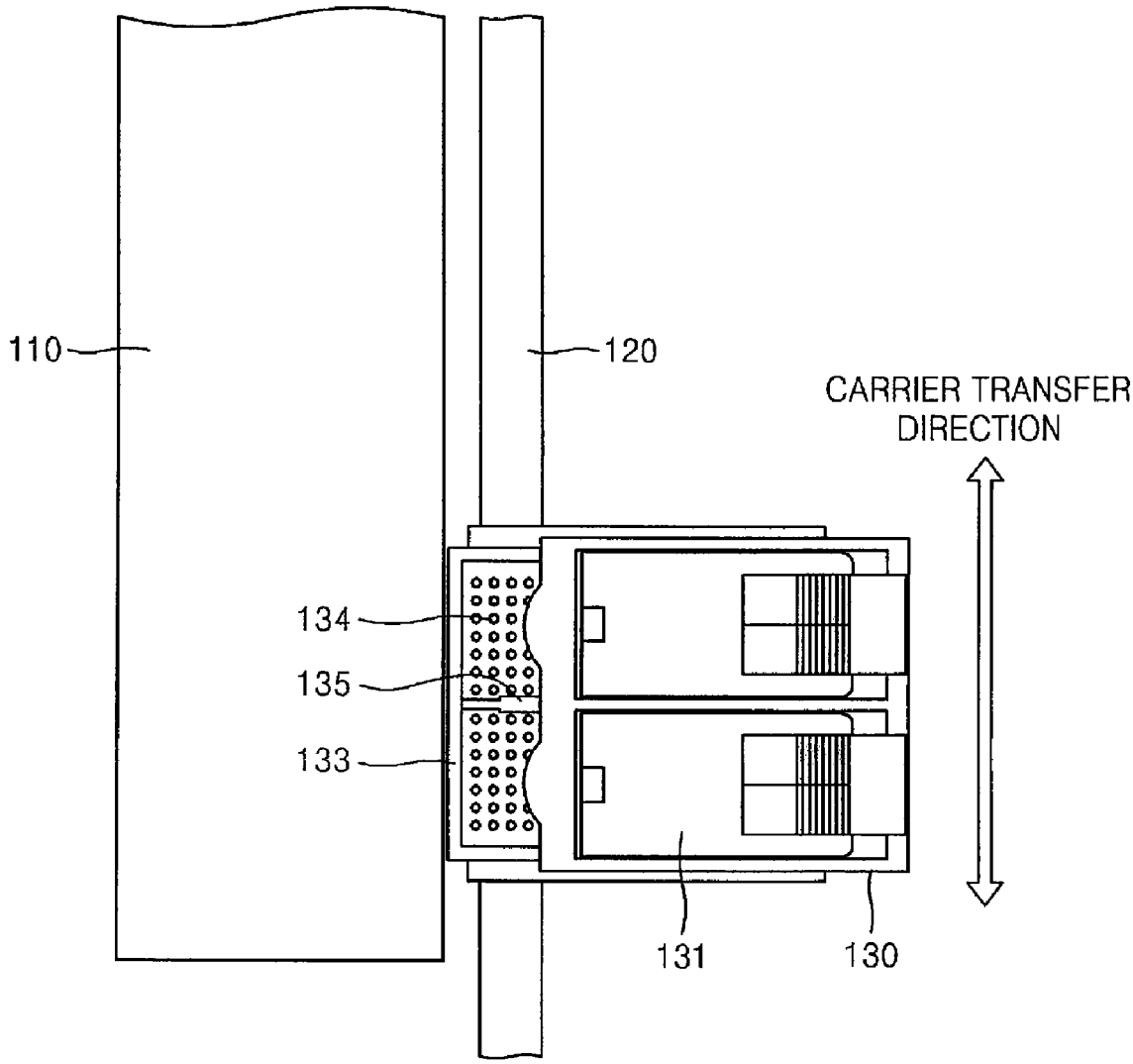

FIGS. 4A and 4B are sided views respectively illustrating a printing operation state and a wiping operation state of the hybrid inkjet head and the wiping device of the image forming apparatus of FIG. 1, and FIGS. 5A and 5B are plan views respectively illustrating a wiping operation standby state and a wiping operation state of the hybrid inkjet head and the wiping device of the image forming apparatus of FIG. 1.

Same reference numerals of FIGS. 1-5B represent the same members or the same parts thereof.

In the present embodiment, the wiping device includes the first guide part 120, the wiper unit 135, the waste ink collecting box 133, and the second guide part 140.

Referring to FIG. 4A, the array type inkjet head 110 is disposed such that the first nozzle unit 112 faces the paper P when a printing operation is performed. In a case where a printing operation is stopped or completed and a maintenance operation is performed, the carrier 130 slides along the first guide part 120 to move to an outside area of the paper P, i.e., an outer portion disposed on one side of a paper path perpendicular to the length direction of the array type inkjet head 110 as illustrated in FIG. 5A. This state is a wiping operation standby state.

As illustrated in FIG. 5A, the shuttle type inkjet head 132 may be disposed in a printing area 170 during the printing operation and in a maintenance area 180 disposed adjacent to the printing area 170 during a maintenance operation on the array type inkjet head 110. A maintenance device 190 may be disposed in the maintenance area 180 to perform a maintenance operation on the shuttle type inkjet head 132. The carrier 130 may move from the printing area 170 to the maintenance are 180 to provide a space in which the array type inkjet head 110 rotates to a position in which the wiper unit 135 performs the wiping operation on the array type inkjet head 110.

Referring to FIG. 4B, the array inkjet head 110 is rotated by 90° counter clockwise by the second guide part 140 through the space provided when the shuttle type inkjet head 132 moves from the maintenance area 180, so that the first nozzle unit 112 closely contacts the wiping plane 135*a* of the wiper unit 135 mounted in the carrier 130. when the wiping operation starts, the carrier 130 moves along the first guide part 120 from the maintenance area 180 to the printing area 170 to face one portion of the array type inkjet head 110 as illustrated in FIG. 5B.

Next, with the first nozzle unit 112 closely contacting the wiping plane 135*a* of the wiper unit 135, the carrier 130 wipes out ink remaining on the first nozzle unit 112 while performing a reciprocating motion in the width direction of the paper P by sliding along the first guide part 120. At this point, ink wiped by the wiper unit 135 flows into the waste ink collecting box 133 along the surface of the wiper unit 135 and a considerable amount of the waste ink 136 is absorbed in the absorber 134.

Figure 6:
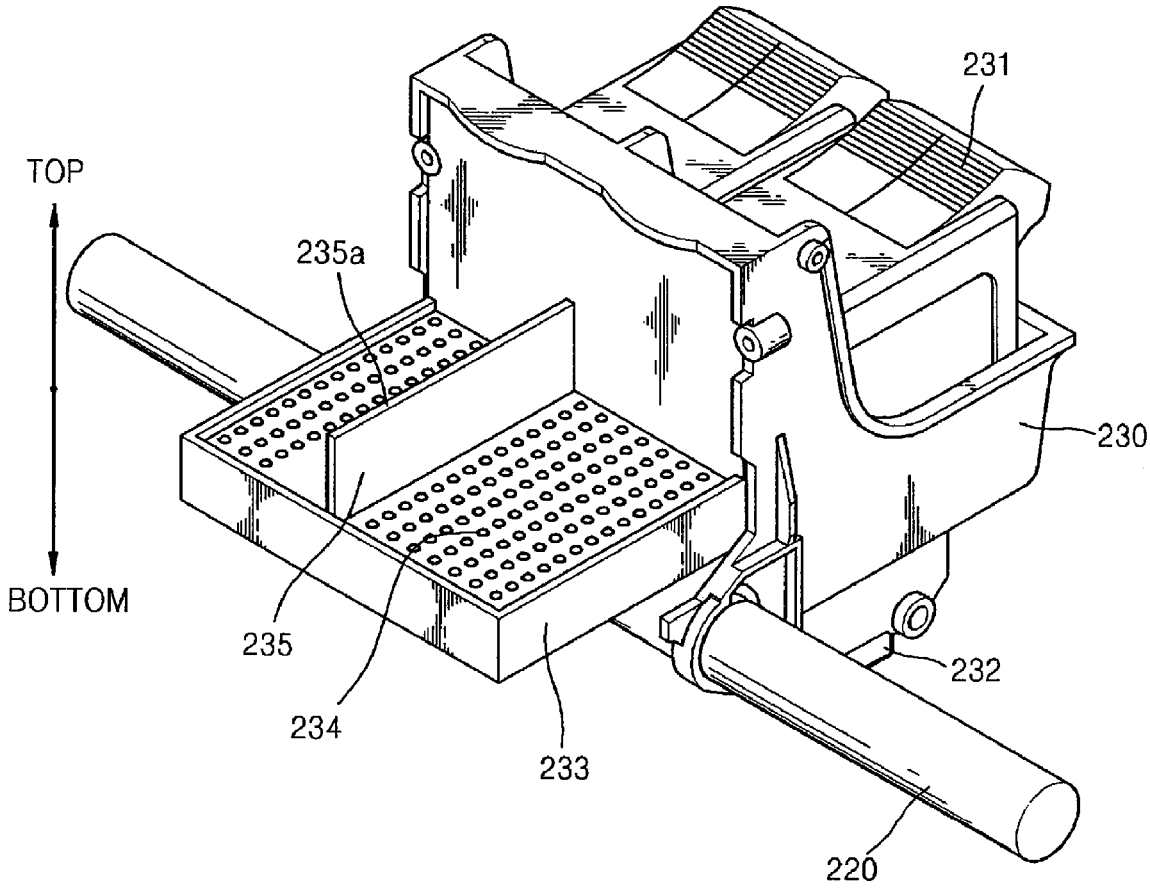
FIG. 6 is a partial perspective view illustrating an image forming apparatus having a hybrid inkjet head and a wiping device thereof according to an embodiment of the present general inventive concept.
Figure 7:
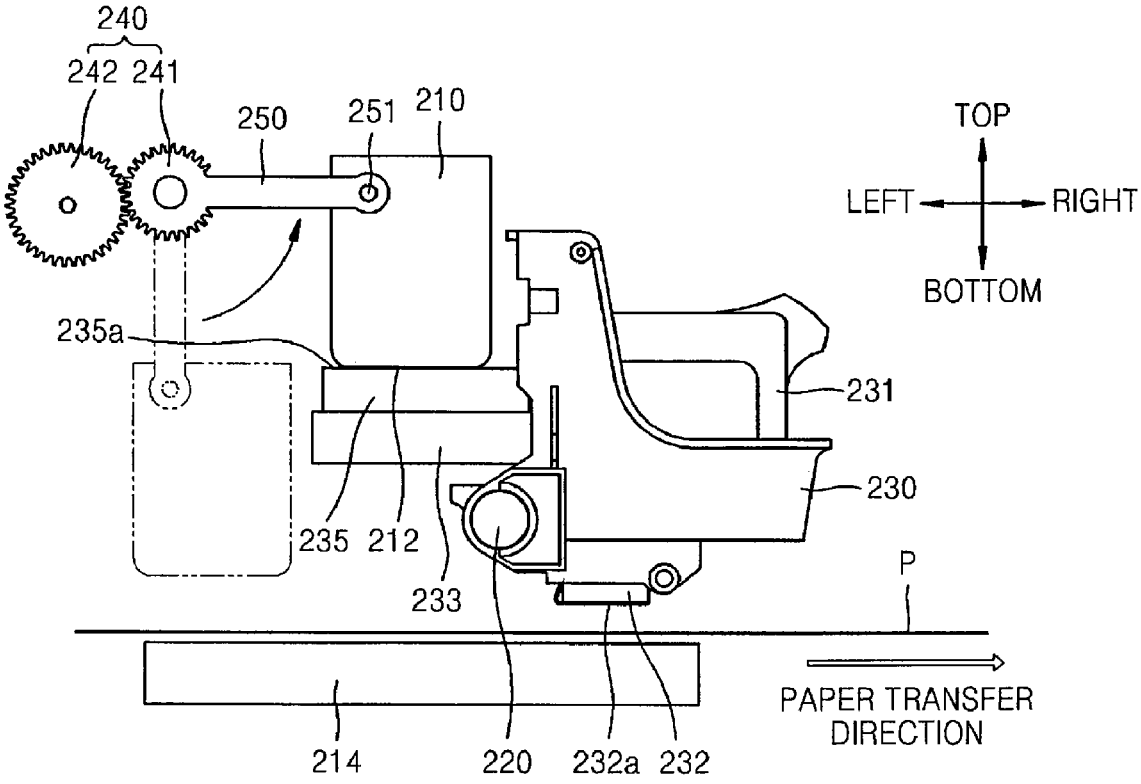
FIG. 7 is a sided view illustrating operations of the wiping device having the wiper unit of FIG. 6.

FIG. 6 is a partial perspective view of a shuttle type inkjet head and a wiper unit in an image forming apparatus having a hybrid inkjet head and a wiping device thereof according to an embodiment of the present general inventive concept, and FIG. 7 is a sided view illustrating operations of the wiping device having the wiper unit of FIG. 6.

Referring to FIGS. 1-7, the image forming apparatus includes the first guide part 220, a carrier 230, a shuttle type inkjet head 232, a wiper unit 235, a waste ink collecting box 233, an array type inkjet head 210, the second guide part 240, and a paper guide (or platen) 214.

The wiper unit 235 has a wiping plane 235*a* to contact the first nozzle unit 212 and to wipe out residual ink thereon.

The waste ink collecting box 233 has an absorber 234 therein.

The array type inkjet head 210 has the first nozzle unit 212 installed thereon and the shuttle type inkjet head 232 has the second nozzle unit 232*a* installed thereon.

The paper guide 214 is disposed on a position facing the first and second nozzle units 212 and 232*a*.

The present embodiment is different from the embodiment illustrated in FIGS. 1 through 5B in the following aspects.

First, the wiping plane 235*a* of the wiper unit 235 is disposed to face upward and has a surface substantially parallel to the first nozzle unit 212.

Second, due to the arrangement of the wiper unit 235, a movement path of the array type inkjet head 210 in a wiping operation and the construction of the second guide part 240 moving the inkjet head 210 are different from those of the embodiment of FIGS. 1 through 5B. That is, to allow the first nozzle unit 212 to contact the wiping plane 235*a* of the wiper unit 235, the second guide part 240 moves the array type inkjet head 210 upward vertically and moves the same to the right horizontally. To perform such operations, the second guide part 240 may include a plurality of gears 241 and 242.

The gear 241 is rotatably coupled to a frame (not shown) of the image forming apparatus and rotates with respect to a rotation axis, i.e., a center of the gear 241, according to a rotation force of the gear 242. An extension 250 is extended from the gear 241 toward the array type inkjet head 210 and rotatably connected to a shaft formed on array type inkjet head 210. When the extension 250 rotates with respect to the rotation axis of the gear 241, the array type inkjet head 210 moves from a printing position (dotted line) to a maintenance position (solid line) as illustrated in FIG. 7. Before the array type inkjet head 210 moves from the printing position (dotted line) to the maintenance position, the carrier 230 with the shuttle type inkjet head 232 moves from the printing area 170 to the maintenance area 180 as illustrated in FIG. 5A. When the array type inkjet head 210 is disposed in the maintenance position, the carrier 230 with the shuttle type inkjet head 232 moves from the maintenance area to the printing area to perform the wiping operation on the array type inkjet head 210.

According to the present general inventive concept, it is possible to provide the image forming apparatus having the hybrid inkjet head, capable of performing a high-speed printing or a high-resolution printing by turns if necessary by adopting the array type inkjet head and/or the shuttle type inkjet head.

According to the present general inventive concept, it is possible to provide the image forming apparatus having the wiping device that can wipe out the above-described hybrid inkjet head while minimizing the installation space and reducing manufacturing costs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an array type inkjet head disposed in a stationary state to print an image onto a printing medium, and having a first nozzle unit of a length that corresponds to at least a width of the printing medium;

a first guide part spaced apart from the array type inkjet head to face the array type inkjet head along a length direction of the array type inkjet head;

a carrier movably coupled with the first guide to perform a reciprocating motion in a width direction of the printing medium;

a shuttle type inkjet head mounted in the carrier to print a second image onto the printing medium, and having a second nozzle unit;

a paper delivery unit to deliver the printing medium to at least one of the array type and shuttle type inkjet heads;

a controller to control operations of the array type and shuttle type inkjet heads and the paper delivery unit to allow ink fired from at least one of the first nozzle unit and the second nozzle unit to be dispersed and impacted onto an appropriate position of the printing medium; and a wiping device to contact a surface of the first nozzle unit of the array type inkjet head and to wipe out residual ink from the nozzle unit of the array type inkjet head, the wiping device comprising:

a wiper unit coupled with the carrier and having one end that contacts the surface of the first nozzle unit of the array type inkjet head to wipe out the residual ink thereon; and a second guide part to rotate the array type inkjet head to allow the surface of the first nozzle unit to contact the one end of the wiper unit.

2. The apparatus of claim 1, wherein the wiper unit is moved to a wiping direction together with the carrier by the first guide part.

3. The apparatus of claim 1, wherein the wiping device further comprises:

a waste ink collecting box to receive the residual ink; and an absorber installed within the waste ink collecting box.

4. The apparatus of claim 1, wherein the wiper unit comprises a wiping plane to contact the first nozzle unit and is disposed such that the wiping plane faces a lateral side of a length direction of the array type inkjet head, and the second guide part rotates by 90° so as to allow the first nozzle unit to contact the wiping plane.

5. The apparatus of claim 1, wherein the wiper unit comprises a wiping plane to contact the first nozzle unit and is disposed such that the wiping plane faces upward, and the second guide part moves the array type inkjet head upward vertically and to the right horizontally to allow the first nozzle unit to contact the wiping plane.

6. The apparatus of claim 1, wherein the wiper unit is formed of rubber.

7. An image forming apparatus comprising:

a first print head having a first nozzle unit;

a second print head having a second nozzle unit;

a carrier to accommodate the second print head; and a maintenance unit formed on the carrier to perform a maintenance operation on the first nozzle unit of the first print head.

8. The apparatus of claim 7, wherein the carrier comprises:

a container portion to receive the second print head;

a connection portion extended from the container portion and having a hole coupled to an external shaft; and a maintenance portion formed on a plate of the container portion as the maintenance unit to perform the maintenance operation on the second nozzle unit of the second print head.

9. The apparatus of claim 7, wherein the maintenance portion comprises a wiping plane disposed in a direction having an angle with a reciprocating direction of the carrier.

10. The apparatus of claim 7, wherein the maintenance unit is disposed between the first print head and the second print head.

11. The apparatus of claim 7, wherein the maintenance unit and carrier are formed in a single body, and move together during a printing operation of second print head and during the maintenance operation on the first print head.

12. The apparatus of claim 7, further comprising;

a first guide unit disposed parallel to the first print head, wherein the carrier is disposed on the first guide unit to reciprocate the second nozzle unit of the second print head to form an image.

13. The apparatus of claim 12, wherein the carrier comprises a connection portion to be connected to the first guide unit, and the maintenance unit and the first print head are disposed opposite to each other with respect to the first guide unit.

14. The apparatus of claim 12, wherein the maintenance unit comprises a wiping plane disposed in a direction having an angle with longitudinal direction of the first guide unit.

15. The apparatus of claim 12, wherein the maintenance unit comprises a waste ink collecting portion disposed along a longitudinal direction of the first guide unit.

16. The apparatus of claim 12, further comprising:

a second guide unit disposed to move the first print head between a printing position and a maintenance position, wherein the carrier moves between a printing area and a maintenance area when the first print head moves between the printing position and the maintenance position.

17. The apparatus of claim 16, wherein the second guide unit comprises a first gear to receive a power from an external power source, a second gear to rotate according to the power of the first gear, and an extension extended from the second gear and coupled to the first print head.

18. The apparatus of claim 7, wherein:

the first nozzle unit of the first print head has a first length in a width direction perpendicular to a feeding direction of a printing medium;

the second nozzle unit of the second print head has a second length shorter than the first length in the width direction; and the carrier has a third length between the first length and the second length in the width direction.

19. The apparatus of claim 18, wherein the maintenance unit has a fourth length corresponding to a length of the first nozzle unit of the first print head in the feeding direction.

20. The apparatus of claim 7, wherein the first print head is disposed in a stationary state to form an image in a printing operation and moves to a maintenance position in a first maintenance operation, and the carrier and the second print head reciprocate in a printing area to form a second image and move from the printing area to a maintenance area disposed outside the printing area to provide a space for the first print head to move to the maintenance position in the first maintenance operation of the first print head.

21. The apparatus of claim 20, wherein when the first print head is disposed in the maintenance position, the carrier moves from the maintenance area to the printing area to control the maintenance unit to perform the maintenance operation on the first nozzle unit of the first print head.

22. The apparatus of claim 20, further comprising:

a second maintenance unit disposed in the maintenance area to maintain the second nozzle unit of the second print head, wherein the second maintenance unit performs a second maintenance operation on the second nozzle unit of the second print head when the maintenance unit of the carrier does not perform the maintenance operation on the first print head.

* * * * *